United States Patent [19]

Oita et al.

[11] 4,059,451

[45] Nov. 22, 1977

[54] ELECTROLESS COPPER PLATING SOLUTION

[75] Inventors: Masahiro Oita, Kashiwara; Hyogo Hirohata; Nobuhiro Hamasaki, both of Neyagawa, all of Japan

[73] Assignee: Matsushita Electric Industrial Co., Ltd., Japan

[21] Appl. No.: 704,618

[22] Filed: July 12, 1976

[51] Int. Cl.[2] ..... C23C 3/02

[52] U.S. Cl. ..... 106/1.26; 427/437

[58] Field of Search ..... 106/1; 427/92, 98, 305, 427/437; 252/355, 357, 2, 3

[56] References Cited

U.S. PATENT DOCUMENTS

| | | | |
|---|---|---|---|
| 3,137,713 | 6/1964 | Shen et al. | 260/400 |
| 3,615,732 | 10/1971 | Shipley et al. | 106/1 |
| 3,959,523 | 5/1976 | Grunwald et al. | 427/98 |
| 3,959,531 | 5/1976 | Schneble et al. | 106/1 |
| 3,959,547 | 5/1976 | Polichette et al. | 427/304 |

*Primary Examiner*—Lorenzo B. Hayes

*Attorney, Agent, or Firm*—Wenderoth, Lind & Ponack

[57] ABSTRACT

An electroless copper plating solution comprising a copper salt, complexing agent, reducing agent, alkali hydroxide and aliphatic perfluorocarbon-containing non-ionic surface active agent is suitable for producing copper deposition having high ductility and good appearance, and further such a solution is very stable even at a high temperature.

4 Claims, No Drawings

ELECTROLESS COPPER PLATING SOLUTION

BACKGROUND OF THE INVENTION

This invention relates to an electroless copper plating solution, and more particularly to a stabilized electroless copper plating solution for providing ductile copper.

Electroless copper plating is a chemical plating of copper on a surface of various substrates such as an insulating substrate, metal, ceramics and plastics by chemical reduction without an external electric current, and it has been used in various fields. See for example, U.S. Pat. Nos. 2,874,072 and 3,307,972, which disclose electroless copper plating solutions. The conventional solutions generally comprise cupric ions of a copper salt such as copper sulfate, a complexing agent for copper such as ethylenediaminetetraacetic acid in an amount sufficient to prevent precipitation of the copper ions in an alkaline medium, a reducing agent such as formaldehyde, and an alkali hydroxide such as sodium hydroxide. However, these conventional electroless copper plating solutions have various drawbacks such as poor stability of the solution and poor ductility and lack of brightness in appearance of the plated copper. These disadvantages are not serious when the electroless deposited copper is of the order of tenths of a micron in thickness and when a further layer of ductile and bright electrolytic copper is plated over the surface of the electroless deposited copper. However, when a comparatively thick layer e.g. having a thickness of over 30 microns is provided by an electroless coppering solution, for example in case of a printed circuit board, the above disadvantages become serious problem.

To overcome these problems, there have been proposed various methods in prior art. For example, U.S. Pat. No. 3,095,309 discloses use of a soluble inorganic cyanide as an additive for improving ductility of the deposited copper, and U.S. Pat. No. 3,804,638 discloses a polyalkylene oxide compound containing at least four alkylene oxide groups of two to four carbons per molecule in an amount sufficient to cause the resultant copper layer to be ductile. Further, U.S. Pat. No. 3,475,186 discloses addition of an organic silicon compound for improving strength, ductility and other properties of the deposited copper, and U.S. Pat. No. 3,615,732 discloses addition of a hydrogen inclusion retarding agent such as alkali and alkaline earth metal cyanides and nitrides, vanadium, molybdenum, niobium, bismuth, tungsten, rhodium, arsenic antimony, rare earths of the actinium series and rare earths of the lanthanum series; formaldehyde addition agent such as alkali metal sulfites, bisulfites and phosphite; and a salt of Group VIII metal such as iron, nickel and platinum for improving the bending or ductility properties of the deposited copper.

SUMMARY OF THE INVENTION

The object of the present invention is to provide an improved and novel electroless copper plating solution for producing a ductile copper deposit of better appearance than that heretofore realized.

Another object of the present invention is to provide an improved electroless copper plating solution that prevents spontaneous decomposition of the solution.

These and other objects and the features of the present invention are realized by providing the electroless copper plating solution according to the invention, which comprises 0.001 to 0.30 mole/l of copper salt, 0.001 to 0.60 mole/l of complexing agent for copper ions, 0.0005 to 0.75 mole/l of reducing agent to reduce cupric ions, 0.05 to 2.0 mole/l of alkali hydroxide, and 0.00001 to 10 g/l of aliphatic perfluorocarbon-containing non-ionic surface active agent.

DESCRIPTION OF THE PREFERRED EMBODIMENT

The subject of the invention is an improved electroless copper plating solution characterized by the addition of a non-ionic aliphatic perfluorocarbon group-containing surface active agent. A typical electroless copper plating solution comprises a copper salt, a complexing agent for the cupric ions, an alkali hydroxide and formaldehyde.

The operable copper salt includes cupric sulfate, cupric nitrate, cupric chloride and other water soluble copper salt, and its concentration is defined from 0.001 to 0.30 mole/l.

Alkali hydroxide, such as sodium hydroxide and potassium hydroxide, is used to make the plating solution alkaline. Generally, pH value of the electroless copper plating solution is defined from 11.0 to 14.0. The pH value less than 11.0 should be avoided because of no reaction of the electroless copper plating, and the pH value above 14.0 results in spontaneous decomposition of the solution.

Suitable complexing agent for the copper ions includes ethylenediaminetetraacetic acid and its alkali salts, Rochelle salt, citric acid and its salts, and others, for example as disclosed in the aforesaid U.S. Pat. No. 3,095,309. The concentration of the complexing agent is defined from 0.001 to 0.60 mole/l sufficient to prevent precipitation of copper ions. Among these complexing agents, ethylene diaminetetraacetic acid and its alkali salts are preferable because they provide cupric complex ions having a better thermal stability at a high temperature, and so they are suitable at a bath temperature higher than 50° C.

A suitable reducing agent is formaldehyde or a similar compound such as paraformaldehyde, and its concentration is defined from 0.0005 to 0.75 mole/l.

In the composition as described above, the aliphatic perfluorocarbon-containing non-ionic surface active agent is added according to the invention, and its concentration is defined as being from 0.00001 to 10 g/l. In the above description, the concentration of each compound less than the respective lower limit is undesirable because it results in a reaction rate which is too low, and practically plating is impossible. Also, the concentration above the upper limit is undesirable because it results in spontaneous decomposition and a plating solution of short life.

A typical electroless copper plating solution comprises 0.005 to 0.12 mole/l of copper salt, 0.006 to 0.35 mole/l of complexing agent, 0.005 to 0.50 mole/l of formaldehyde and 0.1 to 0.5 mole/l of alkali hydroxide sufficient to make pH of the solution 11.0 to 13.0. These concentration ranges are preferable for plating, but it should be understood that they are not critical. An improved electroless copper plating solution according to the invention is provided by adding a fluorocarbon compound as a novel additive, as described above. The concentration of the additive is 0.00001 to 10 g/l as mentioned above, and preferably 0.001 to 1.0 g/l.

The inventors have found that by addition of a surface active agent of a fluorocarbon compound to the usual electroless copper plating solution having the composition as described above, the characteristics of the deposited copper are much improved and further the stability of the solution can be also much improved. The fluorocarbon compound according to the invention is an aliphatic perfluorocarbon group-containing non-ionic surface active agent defined by the formula (1);

$$R_fZ \quad (1)$$

where $R_f$ is a hydrophobic group consisting of an aliphatic perfluorocarbon group containing 3 to 12 carbon atoms or a perfluoroalkyl group in which the hydrogen atoms are partialy or entirely replaced by fluorine atoms, and Z is a hydrophilic group having a structure of a non-ionic type or ionic type, which is further divided into cationic-type and anionic-type.

An aliphatic perfluorocarbon group-containing anionic surface active agent is a carboxylic acid or its salt having the following formula;

$$R_fCOOM \quad (2)$$

where $R_f$ is a perfluoroalkyl group containing 3 to 12 carbon atoms, and M is a hydrogen atom, an alkali or an alkaline earth metal. Another anionic surface active agent having a modified hydrophilic group is represented by the formula (3);

$$R_fSO_2N(R')RCH_2COOM \quad (3)$$

where $R_f$ is the same as defined in the formula (2), R' is a hydrogen atom or an alkyl group containing 1 to 10 carbon atoms, R is an alkylene bridging group containing 1 to 12 carbon atoms, and M is the same as defined in the formula (2).

Other compounds such as a salt of sulfuric acid ester and a salt of sulfonic acid are known as an anionic surface active agent. They have the following formulae (4) and (5), respectively;

$$R_fOSO_3M \quad (4)$$

$$R_fSO_3M \quad (5)$$

where $R_f$ is a perfluoroalkyl group containing 3 to 12 carbon atoms, and M is a hydrogen atom, an alkali or an alkaline earth metal. In addition, the modified compounds of the above salts are also used as a similar anionic surface active agents and they are represented by the formulae (6) and (7), respectively;

$$R_fSO_2N(R')RC_2H_4OSO_3M \quad (6)$$

$$R_fCH_2O(CH_2)_mSO_3M \quad (7)$$

where $R_f$ and M are the same as defined in the foemula (5), R' is a hydrogen atom or an alkyl group containing 1 to 10 carbon atoms, and R is an alkylene bridging group containing 1 to 12 carbon atoms.

Most of these surface active agents are readily available on the market, for example from Minnesota Mining and Manufacturing Company (3M Co.) in U.S.A. as "Fluorad" (tradename) surfactant. That is, according to the catalogue published by Sumitomo-3M Co. in Japan, "Fluorad" surfactants FC-95, FC-98, FC-126 and FC-128 correspond to those of the aliphatic perfluorocarbon-containing anionic surface active agents (Catalogue:$Y_1$-FD(03.75-10)PT-UN).

A cationic perfluoroalkyl group-containing surface active agent is a quaternary ammonium salt having the general formula (8);

$$\left[R_fCONH(CH_2)_p-N\begin{matrix}R_1\\R_2\\R_3\end{matrix}\right]^+ A^- \quad (8)$$

where $R_f$ is a perfluoroalkyl group containing 3 to 12 carbon atoms, $R_1$, $R_2$ and $R_3$ are alkyl groups each containing 1 to 10 carbon atoms, A is an anion, and $p$ is an integer of 2 to 6. Pyridinium salt types having the structure of the formula (9) is also cationic surface active agent resembling to the aforesaid ammonium salt;

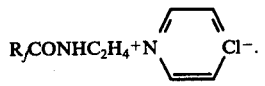

(9)

These surface active agents are also available on the market, for example as "Fluorad" surfactant FC-134 from 3M Co.

Among the various aliphatic perfluorocarbon group-containing surface active agents, the non-ionic type mentioned hereinafter is used as the additive according to the invention. The non-ionic perfluorocarbon-containing surface active agent includes ethylene oxide group-containing compounds, carboxylic acid esters and other compounds, for example "Alkanol", trade name of cationic surface active agent provided by E.I. duPont de Nemours & Co. in U.S.A. Typical structures of these compounds are represented by the following formulae (10) to (13);

$$R_fOH \quad (10)$$

$$R_f(C_2H_4O)_mH \quad (11)$$

$$R_fCOOR \quad (12)$$

$$R_fCOO(CF_2)_nCF_3 \quad (13)$$

where $R_f$ is a perfluoroalkyl group containing 3 to 12 carbon atoms, R is an alkyl group containing 1 to 12 carbon atoms, a vinyl group or an alkyl group, $m$ is an integer of 1 to 15, and $n$ is an integer of 1 to 9.

Other compounds resembling $R_fOH$ ("Alkanol") are also preferred as the additive of the invention, and they are represented by the following formulae (14) to (17);

$$R_fSO_2N(R')RCH_2OH \quad (14)$$

$$R_fCON(R')RCH_2OH \quad (15)$$

$$R_fO(CF_2)_nOH \quad (16)$$

$$R_f(CH_2)_{n'}OH \quad (17)$$

where $R_f$ is the same as defined in the formula (10), R is an alkylene bridging group containing 1 to 12 carbon atoms, R' is a hydrogen atom or an alkyl group containing 1 to 10 carbon atoms, $n$ is an integer of 1 to 9, and $n'$ is an integer of 3 to 12.

Among the ethylene oxide group-containing compounds, there are other preferred compounds as represented by the following formulae (18) to (20);

$$R_fSO_2N(R')R(C_2H_4O)_mH \quad (18)$$

$$R_fCON(R')R(C_2H_4O)_mH \quad (19)$$

$$R_fO(C_2H_4O)_mH \quad (20)$$

where $R_f$ is the same as defined in the formula (11), R and R' are the same as defined in the formula (14) and (15), respectively, and $m$ is an integer of 1 to 15.

In addition, there are other desirable carboxylic acid esters resembled to the structure of the formula (12), as represented by the following formulae (21) and (22);

$$R_fSO_2N(R')RCOOR'' \quad (21)$$

$$R_fCOO(C_2H_4O)_mH \quad (22)$$

where $R_f$, R, R' and $m$ are the same as defined in the formula (18) and R'' is an alkyl group containing 1 to 12 carbon atoms.

These non-ionic perfluoroalkyl group-containing surface active agents are available on the market, for example from 3M Co. as "Fluorad" surfactant FC-170, FC-176, FC-430 and FC-431. That is, it is considered that the surfactant FC-170 is an ethylene oxide group-containing surface active agent defined by the following formula;

$$C_8F_{17}SO_2N(CH_3)—CH_2—(C_2H_4O)_{14}H \quad (23)$$

and FC-176 is an ethylene oxide containing surfactant resembling the above formula (23). The other FC-430 and FC-431 are considered to be of the carboxylic acid ester type.

The aliphatic perfluorocarbon-containing non-ionic surface active agent as described above is added as an additive in the electroless copper plating solution comprising cupric ions, a complexing agent for cupric ions, a reducing agent such as formaldehyde and alkali hydroxide so as to make the deposited copper ductile, to prevent the spontaneous decomposition of the plating bath and to provide a satisfactory appearance of the deposited copper.

The aliphatic perfluorocarbon-containing surface active agent has better heat and chemical resistance characteristics and further it is effective to reduce surface tension. For example, the surface tension of 0.01% aqueous solution of FC-170 and FC-176 surfactants is decreased to 20 dyne/cm and 24 dyne/cm, respectively. Moreover, the hydrophobic group of these surface active agents has both water repellent action and oil repellent action. These properties of the surfactant used in the invention have a desirable influence on the copper plating deposition. For example, the surface active agent is not attacked by the electroless copper plating solution in spite of its strong alkalinity and its high bath temperature of above 50° C.

Among aliphatic perfluorocarbon-containing surface active agents, the non-ionic ones are eminently suitable for use according to the invention. These non-ionic surface active agents used as an additive for the electroless copper plating improve the ductility or bending strength of the deposited copper from the plating solution. Moreover, the appearance of the deposited copper and the stability of the plating solution are much improved by adding the above mentioned non-ionic surface active agent. These improvements obtained by addition of the fluorocarbon surface active agent are considered to occur due to suppression of codeposition of hydrogen which results in poor ductility and dark reddish brown colored appearance without brightness and smoothness. The copper deposition reaction is autocatalytically carried out with the generation of hydrogen gas as represented by the following equation (24);

$$Cu^{++} + 2HCHO + 4OH^- \rightarrow Cu^0 + 2H_2O + 2HCO_2^- + H_2 \quad (24).$$

The anionic perfluorocarbon-containing surface active agents can improve the bending of the deposited copper just slightly. The cationic perfluorocarbon-containing surface active agents have no effect of such improvements, and contrarily the surfactant itself is absorbed and codeposited and results in an unsatisfactory black colored appearance and uneven plated test piece.

The concentration of the surface active agent used in the invention ranges from 0.00001 to 10 g/l, and the preferred range is between 0.001 and 1.0 g/l. The bath temperature should be noticed because it has a remarkable influence on ductility of the deposited copper. Although plating using the solution of the invention can be carried out at any temperature from 0° to 100° C, the preferred temperature range is from 50° to 100° C, at which the bending strength of the deposited copper becomes very high.

The following tables show the results of the use of the various examples of the electroless copper plating solution according to the invention, in comparison with the examples outside the scope of the invention. Table 1 shows the results of the tests for the plating solution having the following composition;

$CuSO_4:5H_2O$: 0.03 mole/l
EDTA*: 0.035 mole/l
HCHO: 0.070 mole/l
NaOH: 0.230 mole/l
(pH 12.50)
(*ethylenediaminetetraacetic acid).

Table 2 shows the results of the tests at changing the composition of the plating solution. In Tables 1 and 2, the asterisk * is the example outside the invention which is shown for comparison. In these examples, the ductility of the deposited copper is evaluated by bending test of an electroless plated copper test piece. That is, employed copper test piece is rolled copper foil having thickness of 10 micron, length of 10 cm and width of 1 cm, and the test piece is immersed in the electroless copper plating solution so as to deposit the copper on each side of the test piece to the thickness of about 10 micron. After the plating is carried out, the test piece is bended to the angle of 180° and brought back to the original position. This cycle constitutes one bend. This procedure is continued until finally the test piece is broken, and the number of bends is counted.

divided copper particles are produced as a useless precipitate.

Table 1

| | Additive | Type | Concentration of additive (g/l) | bath temperature (° C) | deposit thickness (micron) | ductility (bend) | deposit appearance |
|---|---|---|---|---|---|---|---|
| 1* | none | — | — | 15 | 11.6 | 0.5 | dark copper |
| 2* | " | — | — | 30 | 10.5 | " | " |
| 3* | " | — | — | 65 | 10.8 | " | " |
| 4* | " | — | — | 80 | 11.9 | " | " |
| 5* | " | — | — | 85 | 12.1 | " | " |
| 6 | Fluorad FC-170 | non-ion | 0.100 | 30 | 10.0 | 3.0 | bright metallic copper |
| 7 | " | " | 0.050 | 50 | 11.5 | 14.0 | " |
| 8 | " | " | 0.010 | 70 | 10.3 | 17.0 | " |
| 9 | " | " | 0.100 | 85 | 10.6 | 25.0 | " |
| 10 | " | " | 0.250 | 93 | 9.8 | 25.0 | " |
| 11 | Fluorad FC-176 | non-ion | 0.150 | 15 | 10.2 | 2.5 | bright metallic copper |
| 12 | " | " | 0.100 | 40 | 10.3 | 3.0 | " |
| 13 | " | " | 0.100 | 50 | 9.8 | 13.0 | " |
| 14 | " | " | 0.250 | 70 | 10.5 | 18.0 | " |
| 15 | " | " | 0.010 | 85 | 10.5 | 21.0 | " |
| 16 | " | " | 0.450 | 95 | 11.0 | 21.0 | " |
| 17 | Fluorad FC-430 | non-ion | 0.050 | 70 | 9.3 | 11.5 | bright metallic copper |
| 18 | " | " | 0.100 | 80 | 9.8 | 12.0 | " |
| 19 | " | " | 0.050 | 95 | 10.6 | 12.0 | " |
| 20* | Fluorad FC-134 | cationic | 0.100 | 30 | 11.0 | 0.5 | brown or black colored |
| 21* | " | " | 0.100 | 50 | 11.6 | " | " |
| 22* | " | " | 0.150 | 70 | 10.3 | " | " |
| 23* | " | " | 0.200 | 85 | 10.4 | " | " |
| 24* | Fluorad FC-95 | anionic | 0.100 | 30 | 10.6 | 1.5 | fairly good |
| 25* | " | " | 0.150 | 50 | 11.5 | 2.0 | " |
| 26* | " | " | 0.070 | 70 | 11.3 | " | " |
| 27* | " | " | 0.100 | 80 | 10.5 | " | " |
| 28* | " | " | 0.030 | 85 | 9.8 | " | " |
| 29* | Fluorad FC-98 | anionic | 0.100 | 30 | 10.6 | 0.5 | dark |
| 30* | " | " | 0.050 | 50 | 10.6 | 1.0 | " |
| 31* | " | " | 0.150 | 70 | 9.6 | 2.0 | fairly good |
| 32* | " | " | 0.250 | 80 | 9.8 | " | " |
| 33* | " | " | 0.200 | 85 | 10.0 | " | " |
| 34* | Fluorad FC-128 | anionic | 0.100 | 40 | 10.1 | 1.5 | dark |
| 35* | " | " | 0.250 | 55 | 10.9 | 2.0 | fairly good |
| 36* | " | " | 0.100 | 75 | 10.7 | " | " |
| 37* | " | " | 0.300 | 90 | 10.3 | " | " |

Table 2

| Bath Composition | 38 | 39 | 40 | 41 | 42* | 43* |
|---|---|---|---|---|---|---|
| copper nitrate (mole/l) | 0.06 | 0.01 | 0.03 | 0.03 | 0.03 | 0.03 |
| EDTA (mole/l) | 0.09 | 0.02 | — | — | — | — |
| Rochelle salt (mole/l) | — | — | 0.06 | — | 0.06 | — |
| sodium citrate (mole/l) | — | — | — | 0.06 | — | 0.06 |
| formaldehyde (mole/l) | 0.04 | 0.32 | 0.07 | 0.07 | 0.07 | 0.07 |
| caustic soda (mole/l) | 0.38 | 0.22 | 0.25 | 0.25 | 0.25 | 0.25 |
| Fluorad FC-170 (g/l) | 0.100 | — | 0.100 | — | — | — |
| Fluorad FC-176 (g/l) | — | 0.100 | — | 0.100 | — | — |
| pH | 12.8 | 12.3 | 12.5 | 12.6 | 12.5 | 12.6 |
| bath temperature (° C) | 70 | 70 | 35 | 35 | 35 | 35 |
| deposit thickness (μ) | 10.2 | 10.5 | 9.0 | 9.3 | 10.5 | 9.2 |
| ductility (bend) | 10.5 | 13.0 | 3.0 | 3.0 | 0.5 | 0.5 |
| deposit appearance | bright metallic copper | bright metallic copper | bright metallic copper | bright metallic copper | dark | dark |

As apparently understood from the following tables, the advantages obtained by the use of the aliphatic perfluorocarbon-containing non-ionic surface active agent in the electroless copper plating solution include improvement in the ductility of the deposited copper and its appearance. It is also understood that in addition to the effect of the additive, bath temperature has a large effect on the ductility. That is, as seen in the examples at a temperature of above 50° C, the ductility is improved to 10 to 25 bends. Moreover, the non-ionic aliphatic perfluorocarbon-containing surface active agent prevents the spontaneous decomposition of the plating solution. The conventional plating solution without such non-ionic surface active agent is subject to instability at a temperature of above 60° C. That is, at such a temperature reduction reaction of copper ions proceeds rapidly in the conventional plating solution, and finely

What is claimed is:

1. An electroless copper plating solution comprising 0.001 to 0.30 mole/l of copper salt, 0.001 to 0.60 mole/l of a complexing agent for cupric ions, 0.0005 to 0.75 mole/l of a reducing agent to reduce cupric ions, 0.05 to 2.0 mole/l of alkali hydroxide, and 0.001 to 1.0 g/l of $R_fSO_2N(R')R(C_2H_4O)_mH$, wherein $R_f$ is a perfluoroalkyl group containing 3 to 12 carbon atoms, R is an alkylene bridging group containing 1 to 12 carbon atoms, R' is a member selected from the group consisting of a hydrogen atom and an alkyl group containing 1 to 10 carbon atoms, and *m* is an integer of 1 to 15.

2. An electroless copper plating solution according to claim 9, wherein the amount of said copper salt is 0.005 to 0.12 mole/l, the amount of said complexing agent is 0.006 to 0.35 mole/l, the amount of said reducing agent is 0.005 to 0.5 mole/l, and the amount of said alkali hydroxide is 0.1 to 0.5 mole/l.

3. An electroless copper plating solution according to claim 1, wherein said $R_fSO_2N(R')R(C_2H_4O)_mH$ is $C_8F_{17}SO_2N(CH_3)CH_2(C_2H_4O)_{14}H$.

4. An electroless copper plating solution according to claim 1, wherein said solution has a bath temperature of 50° to 100° C.

* * * * *